United States Patent [19]

Fechter et al.

[11] 4,392,952

[45] Jul. 12, 1983

[54] BAR SCREEN WITH SCREEN CLEANER FOR WASTE WATER TREATMENT INSTALLATIONS

[75] Inventors: Leonhard Fechter, Kulmbach; Hubert Jung, Hadamar, both of Fed. Rep. of Germany

[73] Assignee: Passavant-Werke Michelbacher Huette, Fed. Rep. of Germany

[21] Appl. No.: 255,883

[22] Filed: Apr. 20, 1981

[51] Int. Cl.[3] ..... C02C 1/22

[52] U.S. Cl. ..... 210/159; 210/162; 210/170; 210/357; 210/413

[58] Field of Search ..... 210/159, 162, 170, 357, 210/413; 405/36, 118, 119, 80

[56] References Cited

U.S. PATENT DOCUMENTS 1,823,823 9/1931 Dundas et al. ..... 210/413 X
4,107,040 8/1978 Rudolph et al. ..... 210/413 X

FOREIGN PATENT DOCUMENTS 467 2/1979 European Pat. Off. ..... 210/159
1252150 10/1967 Fed. Rep. of Germany ..... 210/159

*Primary Examiner*—David R. Sadowski
*Attorney, Agent, or Firm*—Woodford R. Thompson, Jr.

[57] ABSTRACT

A bar screen with a screen cleaner has a vertically movable carriage with a rake pivotally connected thereto by pivot arms. A foldable lever assembly is pivotally connected to the carriage and to the pivot arms and assures a fully extended position and a folded position which correspond to a position of engagement of the rake with the screen and a position of disengagement of the rake with the screen, respectively. A lower stop engages the foldable lever assembly and moves it from a folded position to an intermediate folded position at the end of downward movement of the carriage and before the lever assembly reaches fully extended position so that the rake remains in a position of disengagement with the screen during downward movement of the carriage and is held in this position until the lever assembly is moved to fully extended position in response to upward movement of the carriage.

4 Claims, 4 Drawing Figures

BAR SCREEN WITH SCREEN CLEANER FOR WASTE WATER TREATMENT INSTALLATIONS

BACKGROUND OF THE INVENTION

This invention relates to a bar screen with a screen cleaner for waste water treatment installations wherein a carriage is mounted for movement by a reversing drive in guides which extend parallel to the trash rack for the bar screen and a rake is pivotally supported by means of pivot arms on the carriage with the rake being moved toward the trash rack as it moves upward and pivoted out to a release position away from the trash rack as it moves downwardly. Such prior art trash rack cleaners have also included an articulated lever arranged between the carriage and the pivot arm which determines the position of the rake when either extended or articulated and which, when the carriage reaches the lowest point of its downward movement, contacts a lower permanent stop to control the motion of the rake.

A prior art type trash rack cleaner is also disclosed in German Pat. No. 1,252,150 wherein the articulated lever is so arranged that during downward motion it holds the rake in the release position, and immediately upon reaching the lower changeover point is articulated by a permanent tripping member so that the rake can be brought into the forward position at the trash rack. This forward movement of the rake occurs initially under its own weight. Also, the hoist device driving the carriage can be changed on the carriage and connected to the pivot arm of the rake so that as the rake is moved upward it is drawn towards the trash rack by means of an additional force corresponding to the weight of the carriage and the rake.

With similar prior art cleaning rakes which are pivoted by means of their own weight against the trash rack, the danger arises that the pivoting force of the rake is not sufficient to collect all of the debris on the water surface in front of the trash rack. In particular, it is possible that the rake would not penetrate the floating debris until it starts to move upwardly when the full weight of the carriage takes effect on the rake by the hoist device, so that uncleared remains of floating debris remain at the bottom of the trash rack.

SUMMARY OF THE INVENTION

An object of our invention is to improve the trash rack cleaner of the type mentioned above in such a way that the rake is pivoted towards with sufficient force and with inward or forward transverse motion not being completed prior to reaching the lower change over point whereby the forward transverse motion is completed only after upward motion of the rake is commenced whereupon the rake is then moved in fully.

According to our invention this function is achieved by the articulated lever being so arranged that it is deflected as the rake is pivoted outwardly and is extended only after the lower tripping point is reached so that the rake is not moved in fully until the rake is moved upwardly. In this way, the rake is guided into the forward position as it is moved upwardly with the upwardly moving rake grasping the debris from beneath.

The advantage of this is that it is not desirable for the articulated lever to move into its fully extended position during the latter part of its downward movement due to the fact that, where the debris has become clogged at the base or bottom of the bar screen, the downwardly moving rake can be overloaded as it presses the debris downwardly. Accordingly, the rake can grasp the debris from beneath after it starts its upward motion. Upward motion of the rake thereafter is guided in the forward position by the extended articulated lever whereby it cannot be moved away from the trash rack by any possible obstructions. A pivoting of the rake completely independent of the weight of the rake or of the carriage can be achieved by employing a drive which exerts a driving force on the carriage as it moves downwardly.

DESCRIPTION OF THE DRAWINGS

Apparatus embodying features of our invention is illustrated in the accompanying drawings, forming a part of this application, in which.

DETAILED DESCRIPTION

Figure 1:
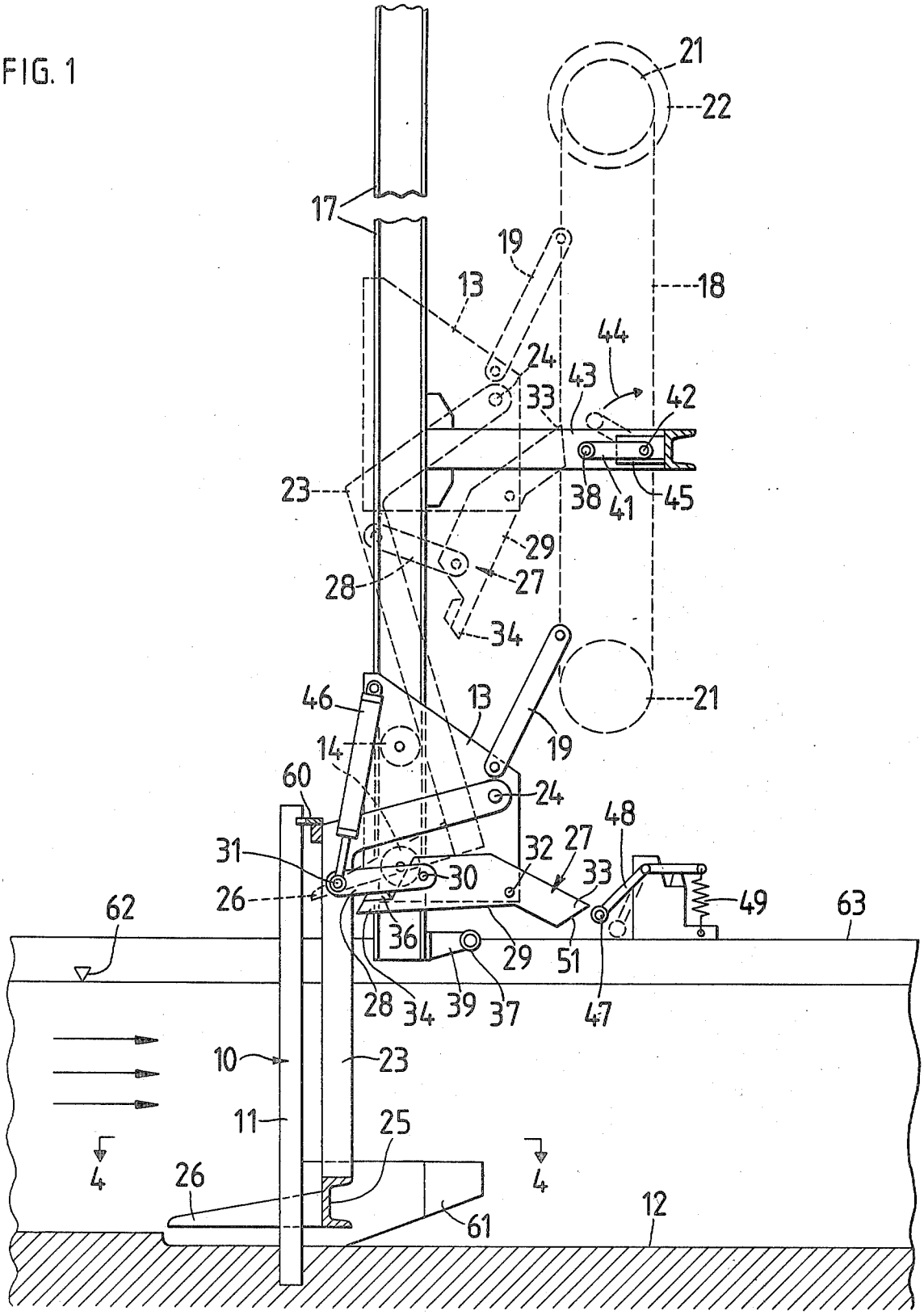
FIG. 1 is a schematic side elevational view, partly broken away and in section, showing the trash rack and trash rack cleaner with the forward position of the rake being illustrated in solid lines and the release position in dotted lines.

Referring now to the drawings for a better understanding of the invention, the trash rack indicated at 10 consists of a plurality of parallel vertical bars 11 which are anchored only at the base 12 of a channel or the like. The bars 11 extend upwardly in spaced relation to each other and are not interconnected or supported by additional means. A carriage 13 having guide rollers 14 is mounted for movement up and down in guideways 17 which extend parallel to the trash rack 10. The carriage 13 is operatively connected to a continuous drive chain 18 by a link 19. The drive chain 18 is of a conventional type which rotates around upper and lower guide sprockets 21 driven by a reversible geared motor 22. The drive chain is reversible so that it can exert a positive driving force on the carriage 13 as it moves upwardly and downwardly. The carriage 13 extends over the entire width of the trash rack 10 and the guideways 17 may comprise guide rails at both sides of the carriage or, where a relatively narrow trash rack 10 is employed, a centrally arranged rail may be employed.

Figure 4:
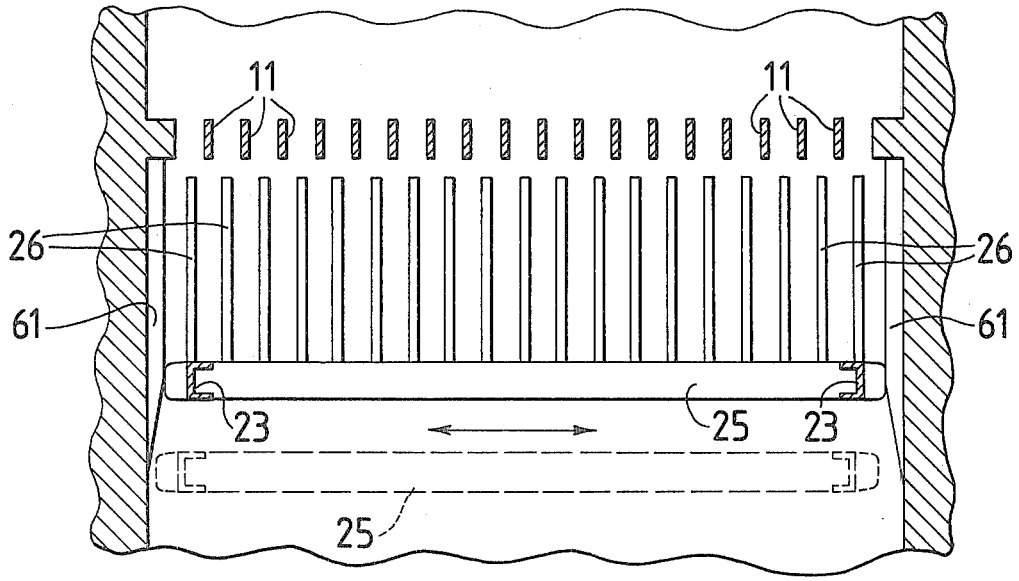
FIG. 4 is a schematic sectional view taken generally along the line IV—IV of FIG. 1.

Angled pivot arms 23 are pivotally connected by suitable bearings 24 to each end of the carriage 13. The arms 23 extend downwardly and carry a rake 25 at their lower ends to remove the floating debris from the trash rack 10. As shown in FIGS. 1 and 4, the rake 25 may consist of a beam which extends between and connects both pivot arms 23 with the teeth 26 of the rake extending forwardly therefrom.

By pivoting the pivot arms 23 in the bearings 24, the rake 25 can be moved into the forward position for upward motion with the teeth 26 passing forwardly through the bars 11 of the trash rack 10, as shown in FIG. 1. In addition, the rake 25 can be moved into the release position in response to downward motion wherein the teeth 26 would then stand clear of the trash rack 10, as shown in dotted lines in FIG. 1. The equipment illustrated in the drawing is an underflow rake in which the rake is arranged on the down-flow side of the trash rack and collects the floating debris on the upflow side by passing through the bars of the trash rack. In like manner, the invention can also be applied to rakes arranged on the up-flow side of the trash rack.

The inward and outward pivoting of the rake 25 is controlled by an articulated lever 27 consisting of guide members 28 and 29 pivotally connected to each other by a pin 30 with the guide member 28 being pivotally connected at 31 to the adjacent pivot arm 23 and the other guide member 29 being pivotally connected at 32 to the carriage 13. The guide member 29 connected to the carriage 13 has an extension 33 extending beyond the pivot connection 32 and an extension 34 extending beyond the pivot pin 30 together with a stop 36 which cooperates with the guide member 28.

The articulated lever 27 cooperates with a lower stop 37 and an upper stop 38. The lower stop 37 consists of a roller, which is supported on a bracket 39 mounted on the guideways 17. The upper stop 38 also consists of a roller which is mounted on a lever 41 which is pivoted as at 42 to an arm 43 carried by the guideways 17 so that the arm 41 can be pivoted upwardly from the horizontal position indicated in FIG. 1 in the direction of the arrow 44. While in the horizontal position, the arm 41 is supported by a stop 45. The upper stop 38 is so arranged that it cooperates with the extension 33 of the guide member 29 while the lower stop 37 is so arranged that it cooperates with the guide member 29 and its extension 34.

Since the pivot connection 32 for the articulated lever 27 on the carriage 13 lies further away from the trash rack 10 than the pivot connection 31 on the pivot arm 23, the pivot arm 23 together with the rake 25 is forced toward the trash rack 10 by extension of the articulated lever 27 while by bending or folding the articulated lever 27 a corresponding movement of the rake 25 away from the trash rack 10 into the position indicated by dotted lines is obtained. The movements of the pivot arms 23 in both directions are cushioned by a double-acting shock absorber 46 mounted between the pivot support point 31 on the pivot arm 23 and the carriage 13. Articulated lever 27, stops 37, 38 and shock absorber 46 may be provided either on one side of the carriage 13 only and connected to one of the pivot arms 23 or, especially in the case of wider trash racks, on both sides of the carriage 13 and connected to both pivot arms 23.

Figure 2:
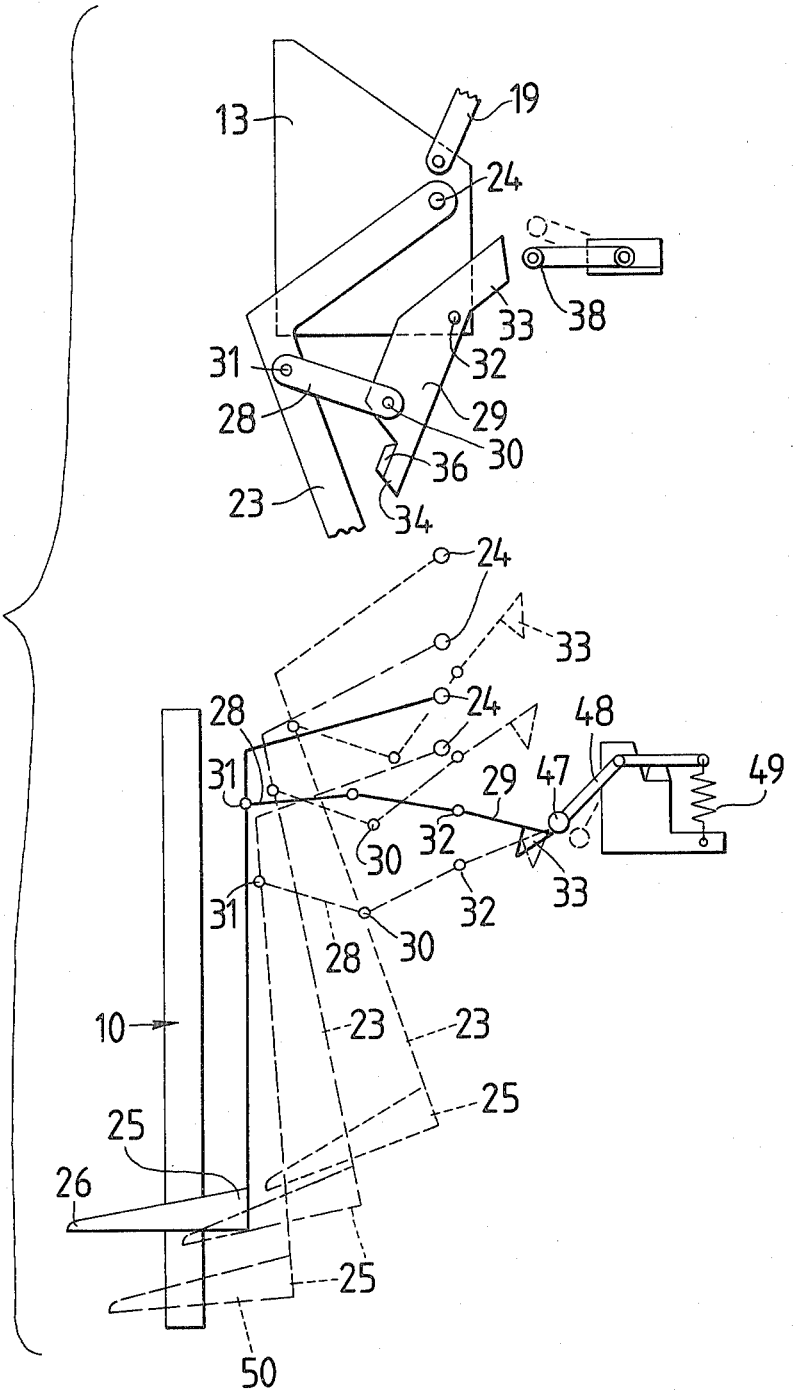
FIG. 2 illustrates schematically the motion imparted to the rake as it pivots inwardly.

As shown in FIGS. 1 and 2, another lower stop 47 is mounted in position to be engaged by the extension 33 of the guide member 29. The stop 47 is carried by a pivoted lever 48 which is urged toward its upper position by a spring 49. A deflecting surface 51 on the extension 33 engages the stop 47 upon downward movement of the carriage 13 and moves the stop 47 counter-clockwise until the extension 33 passes beneath the head of stop 47, which preferably is a roller. The stop 47 is then returned to its normal position by pivoting clockwise due to the force exerted by spring 49. The lowest position of the rake 25 is indicated by dashed lines 50 in FIG. 2. In this position the articulated lever 27 is not totally extended. When the carriage 13 is moved upwardly, the stop 47 limits upward movement of the extension 33 so that the pivot connection 32 moves from the position indicated by dashed lines in FIG. 2 to the solid line position. In this position the articulated lever 27 has exceed its extended position so that the top of the deflecting surface 51 can then pass upwardly by the stop 47. During upward cleaning movement, the guide member 29 is then held in its fixed position by the stop 36.

Figure 3:
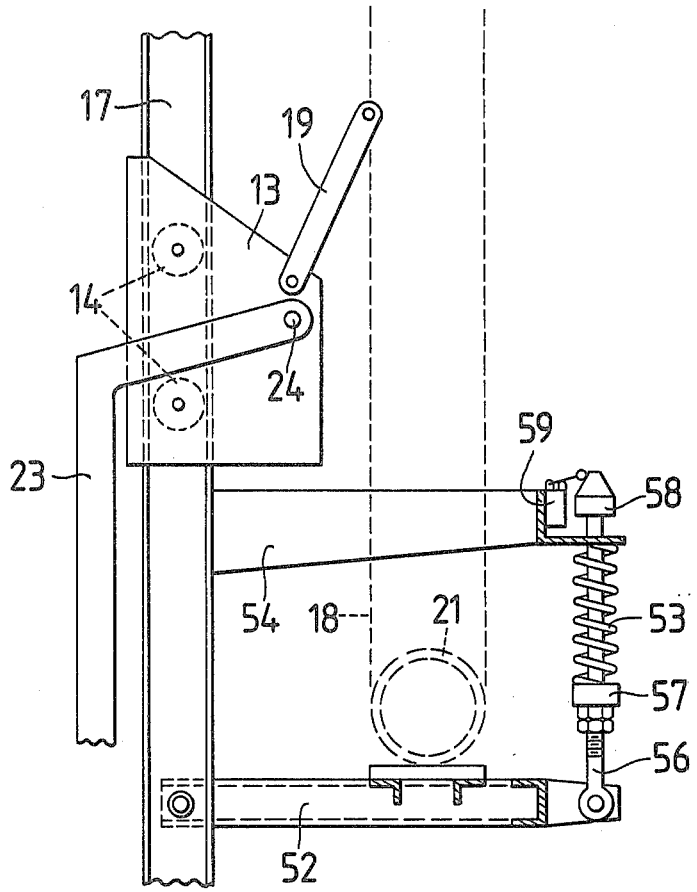
FIG. 3 is a fragmental view showing an overload protection assembly for the drive.

A suitable overload protection, illustrated in FIG. 3, may be provided for the drive which includes a balance arm 52 pivoted to the guideway 17. The lower guide sprocket 21 for the drive chain 18 is mounted on this arm. A similar balance arm can also be provided for the upper guide sprocket 21 and the drive motor 22. A spring 53 retains the balance arm 52 at a preset distance from an arm 54 rigidly connected to the guideway 17. The spring 53 surrounds a bolt 56 which is pivotally connected to the balance arm 52. A variable stop 57 for the spring 53 is provided on the bolt 56 and is movable relative to the arm 54. The head 58 of the bolt 56 is mounted in position to activate a contact switch 59 carried by the arm 54 to deenergize the motor 22. Actuation of the switch 59 occurs during rotation of the chain 18 when the rake 25, and with it the carriage 13 carrying it, is stopped by an obstacle and when, as the chain 18 continues to rotate, the lower guide sprocket 21 tends to climb up the chain 18 at either one or the other side thereof, causing the balance arm 52 and the bolt 56 to be taken with it against the pressure of the spring 53. The spring 53 at the same time also serves the purpose of keeping the drive chain 18 in tension and also to compensate for lengthening of the chain.

As can be seen from FIG. 4 side guides 61 are provided at the lower end of the trash rack 10. The side guides 61 cooperate with the end portions of the rake 25 and ensure that the rake, as it pivots forward, is guided into a position whereby its teeth 26 enter the gaps between the bars of the trash rack 10. This is of advantage because of the considerable length and the small profile width of the pivot arms 23 at angles to the direction of flow. That is, the pivot arms 23 in their rest position lie in the flow cross section of the channel and have little lateral stiffness so that the rake 25, as it travels upwardly, can be offset in relation to the trash rack 10 as indicated in FIG. 4 in broken lines. The great length of the pivot arms 23 has the advantage, on the other hand, that the whole guide mechanism with guides 17 and the carriage 13 lies completely above the water level 62 and even above the top edge 63 of the side walls of the flow channel. Thus guide recesses or the like are not necessary in the side walls.

From the foregoing description, the operation of the equipment will be understood. As the carriage 13 is moved downwardly, the articulated lever 27 is moved to the bent or folded position so that the pivot arm 23 and the rake 25 are pivoted away from the trash rack 10. This occurs due to the fact that the center of gravity of the pivot arms 23 and the rake 25 are positioned so far to the left of the pivot bearing 24, as shown in FIG. 1, that upon release of the pivot arms 23 they retract the rake 25 away from the trash rack 10 until the center of gravity of the pivot arms 23 lies vertically below the bearing support point 24. Other suitable means may be operatively connected to the drive chain 18 to move the rake 25 from its forward position relative to the trash rack 10. Also, if the position of the center of gravity does not permit movement on its own account, the articulated lever 27 itself may be employed to give this movement.

Prior to the end of the downward movement of the pivot arms 23 the extension 34 of each guide member 29 comes into contact with the stop 37 whereupon the articulated lever 27 is gradually urged toward extended position, causing the stop 37 to move along the lower edge of the extension 34 and subsequently along the lower edge of the guide member 29. As the articulated lever 27 is moved toward extended position, the pivot arms 23 and the rake 12 are urged toward the trash rack. Before the articulated lever 27 is completely extended the extension 33 engages and moves the stop 37 to the dotted line position shown in FIG. 1. After the extension passes the stop 47, the spring 49 returns the stop to the upper solid line position. As shown in FIG. 3, the lowest position of the rake 25 is attained before the articulated lever 27 is moved to fully extended position. Upon upward movement of the carriage 13, the stop 47 limits upward movement of the extension 33 until the lever 27 is extended totally. After the lever 27 has exceeded fully extended position the deflecting surface passes the stop 47. The stop 36 then holds the lever 27 in its fixed position during upward cleaning movement. The articulated lever 27 has thus been extended somewhat beyond the dead center so that during the subsequent upward motion of the carriage 13 it remains in the extended position, causing the rake 25 to remain in the forward position.

At the end of upward movement of the pivot arms 23 the extension 33 of the guide member 29 engages the upper stop 38 and moves it outwardly in the direction of the arrow 44. After the drive motor 22 has been reversed by a suitably arranged limit switch, the carriage 13 again moves downwardly whereupon the extension 33 of the guide member 29 again comes into contact with the upper stop 38. Since the stop 38 cannot move downwardly, the guide member 29 is pivoted counterclockwise so that the articulated lever 27 is bent and the rake 25 is then pivoted toward the release position shown in dotted lines in FIG. 1. This position is retained as it continues to move downwardly until the guide member 29 again reaches the lower stop 37, which is before the lever 27 moves to fully extended position. It will be understood that the pivoting of the rake 25 into the forward position at the trash rack 10 is caused after a change-over of the downward motion of the carriage 13 and after upward movement of the carriage commences with the pivoting of the pivot arms 23 being controlled by the extension of the articulated lever 27.

The bent or generally L-shaped shape of the pivot arms 23, as can be seen from FIG. 1, has the advantage that, on the one hand, the pivot point 24 can lie at a considerable distance from the plane of the trash rack 10 and, on the other hand, the pivot arms 23 extend generally parallel to the trash rack 10 over their total height. Accordingly, it is possible to incorporate supports on the pivot arms 23, for example, in the form of strips 60 which extend over the total width of the trash rack 10 with teeth or the like passing between the bars of the trash rack 10. When very high trash racks 10 are employed, several such support strips can be arranged at different heights on the pivot arms 23. This enables the bars of the trash rack 10, which are only anchored at the base 12 of the flow channel, to extend upwards freely and without any interconnections. This is advantageous for movement of the rake 25 over and above the top edge of the trash rack and for the unimpeded discharge of the screenings. However, the bars of the trash rack 10 are adequately supported in the vicinity of their upper ends during normal operation when the rake 25 is in the best position adjacent the lower reversing point. If the trash rack were to lack such support, it could occur that floating debris could enlarge the gaps between the bars and force its way through the trash rack.

The bent shape of the pivot arms 23 has another advantage in that the supporting pivot point 31 of the guide member 28 can be arranged offset in relation to the straight connecting line between the pivot bearing 24 and the rake 25 in the direction towards the trash rack 10 whereby a greater length can be obtained for the articulated lever 27 thus resulting in a savings in energy.

The reversible drive 22 for the carriage 11 can be obtained by other means than by means of the chain 18. For example, by means of a continuous driven cable, a pulley belt or a toothed belt, by a drive spindle reversing its direction of rotation with corresponding spindle nuts on the carriage 13, or by means of a linear motor.

As can be seen from FIG. 1, the top edges of the teeth 26 of the rake 25 slope downwardly in the direction of the ends to form an included obtuse angle with the bars of the trash rack 10. Accordingly, as the rake 25 pivots forward this causes the debris to be lifted up slightly and loosened. In addition the descending top edges of the teeth 26 facilitate wiping clean or the discharge of screenings at the top reversing point.

In the embodiments described above the center of gravity of the rake 25 and its pivot arms 23 is so arranged that as the articulated lever 27 is bent, the rake 25 pivots back by its own weight and is retained in the release position. In addition, the articulated lever 27 supports the rake 25 as it is pivoted outwardly and rearwardly and as long as its extension 33 lies above the stop 38 whereupon it is then pivoted by stop 38 upon downward movement of lever 27.

An important advantage of our trash rack cleaner lies in the fact that the articulated lever 27 has not reached its fully extended position at the lowest point of travel of the rake so that upon commencing upward movement of the carriage the lever is then fully extended whereby the rake grasps the debris from underneath thus preventing overloading of the rake.

While we have shown our invention in but one form, it will be obvious to those skilled in the art that it is not so limited, but is susceptible of various changes and modifications without departing from the spirit thereof.

What we claim is:

1. In a bar screen with a screen cleaner for waste water treatment installations, embodying a carriage cooperating with means for movement upwardly and downwardly in guides extending parallel to said screen, a rake for cleaning said screen pivotally connected to said carriage by pivot arms with said rake being pivotable by means of said pivot arms between a first position of engagement with said screen and a second position of disengagement with and spaced from said screen, a foldable lever assembly pivotally connected to said carriage and pivotally connected to said pivot arms and movable in a path of movement from a fully extended position to a first folded position which correspond to said first and second positions, respectively, of said rake and a lower stop means mounted in the path of movement of said foldable lever assembly, said lower stop means for engaging and moving said foldable lever assembly from said first folded position to an intermediate folded position at the end of the downward movement of said carriage and before said lever assembly reaches said fully extended position with said rake being retained in said second position of disengagement during downward movement of said carriage and being pivoted by the change of position of said lever assembly into a partially engaged position until said lever assembly is moved to said fully extended position, a stop member means mounted near the lowermost point of travel of said lever assembly for engaging and pivoting said lever assembly to its fully extended position only during upward movement and after commencement of upward movement of said carriage and after said lever assembly has been moved into said intermediate folded position by said lower stop means, said stop member means also for providing that movement of said rake into said first position of engagement with said screen is only completed after commencement of upward movement of said carriage and said rake is positively retained in the position of engagement with said screen while said lever assembly is in said fully extended position.

2. A bar screen with screen cleaner as defined in claim 1 in which said stop member means is carried by one end of a pivotable lever which is mounted in the path of movement of an extension of one end of said foldable lever assembly with the other end of said pivotable lever being supported at its pivot point and resilient means operatively connected to said pivotable lever urges said stop member means upwardly to a predetermined upper position so that upon downward movement of said extension said stop member means is moved downwardly until said stop member means passes therebeneath whereupon said resilient means then returns said pivotable lever to said upper position before said foldable lever assembly is fully extended with upward movement of said carriage moving said extension into engagement with said stop member means until said foldable lever assembly is moved to a position which exceeds fully extended position whereupon said extension then moves upwardly past said stop member means.

3. A bar screen with screen cleaner as defined in claim 2 in which said stop member means at one end of said foldable lever is a roller.

4. A bar screen with screen cleaner as defined in claim 2 in which said extension of one end of said foldable lever assembly is provided with a deflecting surface in position to engage said stop member means.

* * * * *